United States Patent [19]

Kurtz

[11] Patent Number: 4,548,846

[45] Date of Patent: Oct. 22, 1985

[54] PRESS-ON TYPE FINGER PULL

[76] Inventor: Thomas D. Kurtz, 510 Island View Rd., Rock Falls, Ill. 61071

[21] Appl. No.: 669,618

[22] Filed: Nov. 8, 1984

[51] Int. Cl.[4] ..... A47B 95/02; E05D 1/00

[52] U.S. Cl. ..... 428/40; D8/3; 16/124; 248/205.3; 428/79; 428/156

[58] Field of Search ..... 428/40, 79, 156; D8/3; 16/124; 248/205.3

[56] References Cited

U.S. PATENT DOCUMENTS

| | | | |
|---|---|---|---|
| 3,036,945 | 5/1962 | Souza | 428/174 X |
| 3,180,058 | 4/1965 | Tillisch et al. | 428/312.4 X |
| 3,524,215 | 8/1970 | Kurtz | 16/124 |
| 3,961,119 | 6/1976 | Thomas | 428/178 |
| 3,962,504 | 6/1976 | Sherwin | 428/49 X |

*Primary Examiner*—Henry F. Epstein
*Attorney, Agent, or Firm*—Vernon J. Pillote

[57] ABSTRACT

A press-on type finger pull for application to the face of glass panels and the like comprising a rigid body of transparent material having a mounting surface embossed in a pattern to define ridges separated by shallow recesses with the apices of the ridges coplanar. A thin preformed layer of pressure sensitive adhesive having a sheet of peelable cover material on one side has its other side adhered to the ridges of the embossed mounting surface and extends across the recesses above the base of the recesses to disperse air bubbles.

8 Claims, 7 Drawing Figures

PRESS-ON TYPE FINGER PULL

BACKGROUND OF THE INVENTION

U.S. Pat. No. 3,524,215 issued to the present applicant, discloses a finger pull having a flat rear mouting face and a layer of pressure sensitive adhesive on the rear mounting face for adhesively securing the finger pull on the surface of glass panels and the like. Finger pulls made in accordance with that patent have been marketed for many years and have performed well in use. However, in these prior press-on finger pulls, air bubbles frequently became trapped between the layer of adhesive on the finger pull and the surface to which the layer of adhesive was adhered, and these air bubbles prevented intimate contact between the adhesive layer and the adjacent surface in relatively large and irregular areas. When the finger pulls were mounted on a panel, the trapped air bubbles gave the finger pull a clouded or mottled appearance as viewed from the front, if the finger pull was formed of a transparent material, and also produced on objectionable mottled appearance when viewed from the rear side, when the finger pulls are mounted on glass panels. In addition, the trapped air bubbles reduced the overall strength of the adhesive bond between the finger pull and the panel since the bubbles produce substantial areas where the adhesive layer was either not in adhering contact with the panel or with the mounting surface of the finger pull.

In an effort to overcome the mottled appearance when the finger pulls were formed of a transparent material, some prior art finger pulls formed of transparent material were formed with an embossed surface on the front face, that is on the face opposite the rear mounting face. However, the clouded or mottled pattern due to the presence of air bubbles between the mounting face of the finger pull and the adhesive and also due to the presence of air bubbles between the adhesive and the face of the panel, were still visible through the finger pull, and were also visible from the back side when the finger pulls were mounted on glass panels. Press-on finger pulls formed of transparent material have also been made with a mirrored finish on the mounting face, and other have been made of an opaque material or coated so as to be opaque. While the finger pulls having a mirrored mounting surface and those which were opaque or coated to be opaque, did conceal the mottling caused by air bubbles between the adhesive layer and the adjacent surfaces, when the finger pulls were viewed from the front, they were not effective to conceal the mottled appearance if the finger pulls were mounted on a glass panel and viewed from the rear.

SUMMARY OF THE INVENTION

It is the object of the present invention to overcome the mottled appearance that occurred in prior press-on type finger pulls due to air bubbles trapped between the adhesive layer and the surfaces of the finger pull and panel adjacent thereto.

Accordingly, the present invention provides a press-on type finger pull for application to the face of glass panels and the like and which comprises a rigid body having a mounting surface at one side and a finger engaging means at the side opposite the mounting surface. The mounting surface is embossed in a pattern to define ridges separated by shallow recesses, with the apices of the ridges being coplanar. A thin preformed layer of pressure sensitive adhesive having a sheet of peelable cover material on one side, is adhered at its other side to the ridges on the embossed mounting surface with a layer of adhesive extending across the recesses above the base of the recesses. The recesses have a length substantially greater than their width to disperse air bubbles trapped between the adhesive layer and the mounting surface over a substantial area of the mounting surface, and the pressure sensitive adhesive layer is sufficiently resilient and deformable to distend into the recesses and disperse air bubbles trapped between the face of the panel and the adhesive layer when the latter is pressed against the panel.

The embossed mounting surface of the finger pull is preferably spaced inwardly from the edges of the finger pull to provide a narrow marginal border around the embossed surface, and the border is disposed at a level adjacent the base of the recesses in the embossed surface with at least some of the recesses communicating with the border.

DETAILED DESCRIPTION

Figure 1:
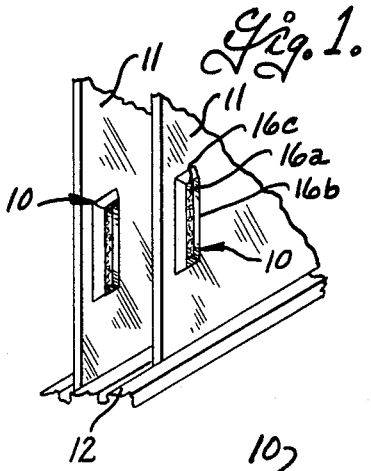
FIG. 1 is a fragmentary perspective view of a pair of sliding glass panels having finger pulls of the present invention applied thereto.
Figure 2:
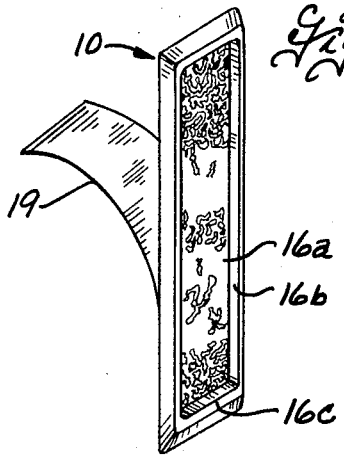
FIG. 2 is a frontal perspective view of a press-on type finger pull illustrating removal of the protective cover sheet.

The present invention relates to a press-on type finger pull 10 for application to the face of glass panels 11 and the like. In the preferred embodiment illustrated, the finger pull 10 has an overall configuration similar to that disclosed in my prior U.S. Pat. No. 3,524,215, to adapt the same for use on sliding panels. As shown in FIG. 1, the finger pull 10 is mounted on the face of each of a pair of transparent glass panels 11 that are supported for sliding movement in trackways 12. The press-on finger pulls disclosed in my prior patent had a low profile with a finger receiving depression in the front face, and did not obstruct sliding movement of the panels past each other. It is contemplated however, that the invention can be utilized with other types of press-on finger pulls such as those having knobs on their front side.

The finger pull 10 comprises a rigid body, preferably formed of a transparent synthetic resin material, and which has a mounting surface 15 at one side and a finger engaging means at the side opposite the mounting surface. In the finger pull shown, the body is made relatively thin, for example of the order of $\frac{1}{8}''$ in thickness, and the body is formed with a finger receiving depression 16*a* in its outer face and which depression is surrounded by side and end flanges 16*b* and 16*c*, respectively. When the finger pull is mounted on the face of the panel 11, the side flanges 16*b* can be engaged by the tips of the user's fingers to push the panel in one direction or the other along the trackway. Because of the thin profile of the finger pull and the absence of projecting knobw, the finger pull does not interfere with sliding of the panels past each other.

The press-on finger pulls disclosed in my prior U.S. Pat. No. 3,524,215, had a smooth flat rear mounting surface and air bubbles frequently became trapped between the pressure sensitive adhesive and the rear mounting surface on the finger pull during application of the adhesive transfer tape to the finger pull, and air bubbles also frequently became trapped between the pressure sensitive adhesive and the panel surface, when applying the finger pull to the panel. These trapped air bubbles spread out and prevented intimate contact between the adhesive layer and the adjacent surfaces of the finger pull and panel in some areas. There is a substantial difference in the reflection and defraction of needed light between the areas where the adhesive layer is in intimate contact with the adjacent surface and the areas where the adhesive layer is not in intimate contact with the surface. When the finger pulls were formed of a transparent material, these air bubbles produced a clouded or mottled appearance when the finger pulls were viewed from the front and, when the finger pulls were mounted on transparent panels such as glass panels, they also produced a similar mottled appearance when viewed through the glass panel from the back. In addition, the trapped air bubbles reduced the effective bonded areas and the overall strength of the adhesive bond between the finger pull and the panel since there were substantial areas where the adhesive layer was either not in adhering contact with the panel or with the finger pull.

Figure 6:
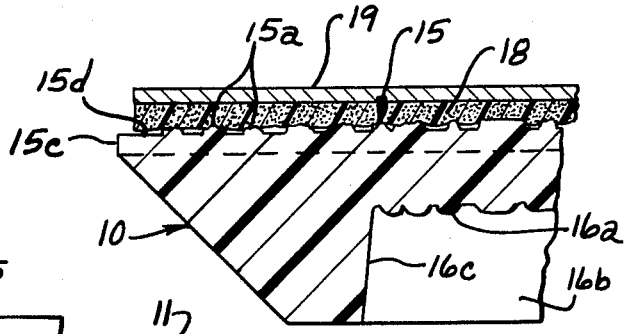
FIG. 6 is a fragmentary transverse sectional view through a finger pull with the pressure sensitive adhesive and protective backing applied thereto.
Figure 4:
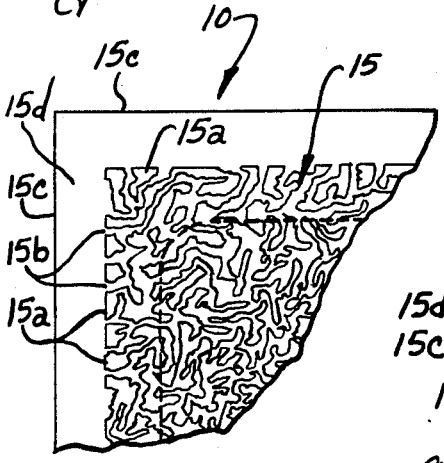
FIG. 4 is a fragmentary view illustrating a portion of the rear side of the finger pull body on a larger scale than FIG. 3.

In accordance with the present invention, the rear side of the finger pull is formed with a mounting surface that is embossed in pattern to define ridges 15*a* separated by shallow recesses 15*b*, with the apices of the ridges 15*a* disposed substantially coplanar. A thin preformed layer of resilient and deformable pressure sensitive adhesive 18 having a sheet of peelable cover material 19 on one side, has its other side adhered to the ridges 15*a* on the embossed mounting surface, with the adhesive layer extending across the recesses between the ridges above the base of the recesses, as shown in FIG. 6. The layer of pressure sensitive adhesive is relatively thin and is preferably of the order of 5 mil to 10 mil. The pressure sensitive adhesive 18 and cover sheet 19 may, for example, be an adhesive transfer tape of the type sold by Minnesota Mining and Manufacturing Company of Minneapolis, Minn. under the brand name "Isotac".

The recesses 15*b* in the embossed surface are preferably shallow, for example of the order of 0.002 to 0.003 inches, and are made long and narrow to disperse air bubbles that may be trapped between the adhesive layer and the mounting surface over a substantial area at the rear side of the finger pull. It was also found that the embossed mounting surface also functioned to disperse air bubbles trapped between the adhesive layer and the face of the panel, when the finger pull was pressed onto the panel. It is believed that, when air bubbles are trapped between the adhesive layer 18 and the panel 11 during mounting of the finger pull on the panel, that the thin resilient and deformable adhesive layer distends as indicated at 18*a* in FIG. 6 into the recesses 15*b* in the rear side of the finger pull and that somewhat complimentary recesses such as indicated at 18*b* in FIG. 6 will be formed between the adhesive layer and the glass panel. These recesses 18*b* accommodate and disperse the air bubbles that occur between the adhesive layer and face of the panel. When the press-on finger pulls of the present invention with the embossed mounting face are applied to a panel 11, the finger pulls do not have a mottled or cloudy appearance such as occurred in the prior finger pull having a smooth flat back. When the finger pull of the present invention is viewed from the back through the glass, and with the incident light at an angle to the plane of the glass, the embossed pattern on the mounting face of the finger pull is clearly defined, with the portions opposite the ridges on the embossed rear face of the finger pull having a translucent to transparent appearance indicative that the layer of pressure sensitive adhesive is in intimate adhering contact with the glass in those areas. On the other hand, the areas opposite the recesses in the embossed face of the finger pull reflect the light at a higher rate indicative that the adhesive layer in these areas is in less intimate contact or out of contact with the glass. Overall, the defraction pattern of the finger pull with the embossed mounting surface on its rear side is substantially the same as the embossed pattern on the rear side of the finger pull and is markedly more pleasing than the clouded or mottled light defraction pattern produced by the prior finger pull with a smooth flat rear surface.

Since the adhesive layer appears to be in intimate contact with the embossed face of the finger pull and the face of the panel 11 only in those areas opposite the ridges 15*a* on the embossed face of the finger pull, the effective bonding area of the embossed finger pull to the panel is less than the total face area of the rear side of the finger pull. It is accordingly advantageous to make the total area of the ridges on the embossed mounting surface a substantial portion of the total area of the mounting surface. On the other hand, it is also necessary to make the width of the recesses in the embossed surface sufficiently wide to allow the adhesive layer to distend into the recesses in order to disperse air trapped between the adhesive layer and the face of the panel. As previously pointed out, the adhesive layer 18 preferably has a thickness of about 5 mils and not substantially greater than 10 mils. In order to allow the adhesive layer to distend into the recesses in the embossed surface of the finger pull, it is believed necessary to make the width of the recesses somewhat greater than the thickness of the adhesive layer.

Figure 3:
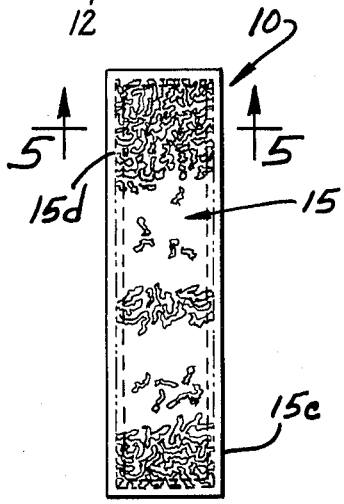
FIG. 3 is a rear view of the body of a finger pull embodying the present invention.
Figure 5:
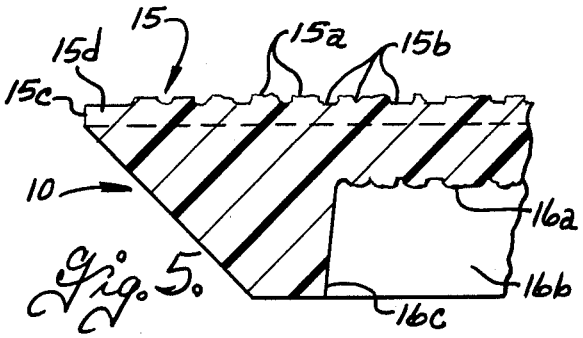
FIG. 5 is a transverse sectional view through the finger pull body taken on the plane 5—5 of FIG. 3, on a larger scale than FIG. 3.
Figure 7:
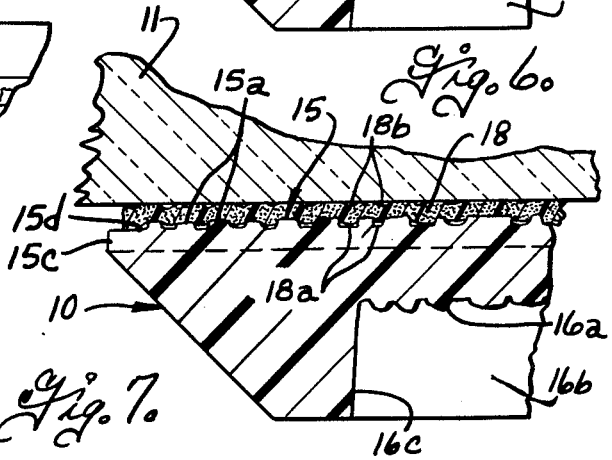
FIG. 7 is a fragmentary sectional view illustrating the finger pull mounted on the face of a glass panel.

As previously described, it is desirable to make the recesses 15*b* long and narrow to disperse trapped air bubbles over a relative large area. In order to maximize the area of the ridges 15*a*, the latter are also preferably long and narrow and, preferably, the area of the ridges on the embossed mounting surface comprise not less than about 40% and not more than about 60% of the area of the mounting surface. The finger pull is conveniently molded with the embossed mounting surface and, in order to minimize formation of sprues at the edge of the finger pull during molding, the embossed mounting surface is spaced inwardly from the edges 15*c* of the mounting surface to provide a narrow marginal border 15*d* around the embossed mounting surface. The marginal border 15*d* is disposed at a level adjacent the base of the recesses as shown in FIGS. 5–7 and at least some of the recesses open at the marginal border as shown in FIG. 3, to facilitate venting of trapped air bubbles. In the embodiment illustrated, the embossing has a random pattern, it being understood that other embossing patterns could be used if desired.

From the foregoing it is thought that the construction and manner of use of the press-on finger pull will be readily understood. The rear face of the finger pull is embossed in a pattern to provide ridges and recesses that are long as compared to their width to disperse air bubbles trapped between the pressure sensitive adhesive layer and the embossed mounting surface, when the pressure sensitive layer is applied to the rear face of the finger pull. The thin layer of pressure sensitive adhesive is resilient and deformable so that it can distend into the recesses in the rear mounting surface of the finger pull, when the finger pull is mounted on the panel, to disperse air bubbles that are trapped between the pressure sensitive adhesive layer and the surface of the panel. The embossed mounting surface avoids the cloudy or mottled appearance of the prior press-on type finger pull having a flat rear mounting face, and substantially improves the overall appearance of the finger pull when viewed from the front, when the finger pull is formed of a transparent material, and also improves the appearance of the finger pull when viewed from the back through a transparent panel. It is believed that the pressure sensitive adhesive layer is in intimate contact with the finger pull and the panel primarily in the areas opposite the ridges 15*a* on the embossed mounting surface. It is recognized that the effective bonding area with the embossed mounting surface is less than the full area at the rear side of the finger pull. However, the strength of the pressure sensitive adhesive bond of the finger pull to the panel has been found to be adequate. Since the prior press-on finger pulls with a flat mounting surface had relatively large areas where the adhesive layer was either not in intimate contact with the flat face of the finger pull or not in intimate contact with the glass panel, the effective bonding area in the prior finger pull was also substantially less than the total area of the rear side of the finger pull.

The embodiments of the invention in which an exclusive property or privilege is claimed are defined as follows:

1. A press-on type finger pull for application to the face of glass panels and the like comprising, a rigid body having a mounting surface at one side and finger engaging means at the side opposite the mounting surface, the mounting surface being embossed in a pattern to define ridges separated by shallow recesses, the apices of the ridges being coplanar, a thin preformed flat layer of pressure sensitive adhesive having a sheet of peelable cover material on one side and having the other side adhered to the ridges on the embossed mounting surface and extending across the recesses therebetween above the base of the recesses, the recesses having a length substantially greater than their width to disperse air bubbles trapped between the adhesive layer and the mounting surface over a substantial area of the mounting surface, the pressure sensitive adhesive layer being sufficiently resilient and deformable to distend into the recesses and disperse air bubbles trapped between the face of a panel and said one side of the adhesive layer when the latter is pressed against the panel.

2. A press-on type finger pull according to claim 1 wherein the embossed mounting surface is spaced inwardly from the edges of said one side of the body to provide a narrow marginal border at said one side of the body around the embossed mounting surface.

3. A press-on type finger pull according to claim 2 wherein the marginal border at said one side of the body is disposed at the level of the base of the recesses, at least some of said recesses opening at said marginal border.

4. A press-on finger pull according to claim 3 wherein said rigid body is formed of a transparent synthetic resin material.

5. A press-on finger pull according to claim 3 wherein said layer of pressure sensitive adhesive has a thickness in a range of about five to ten mils and the recesses have a width greater than the thickness of the layer of adhesive.

6. A press-on finger pull according to claim 5 wherein the area of the ridges on the embossed mounting surface comprise about 40 to 60% of the area of the mounting surface.

7. A press-on finger pull according to claim 6 wherein said rigid body is formed of a transparent synthetic resin material.

8. A press-on finger pull according to claim 4 wherein said first body has a central finger receiving recess and a marginal flange around said recess providing said finger engaging means.

* * * * *